US012529222B2

(12) United States Patent
Frederiks

(10) Patent No.: US 12,529,222 B2
(45) Date of Patent: Jan. 20, 2026

(54) HORIZONTAL FLOOR MADE UP OF A LOAD-BEARING STRUCTURE AND FLOOR PANELS LAID THEREON

(71) Applicant: NEDCON B.V., Doetinchem (NL)

(72) Inventor: Jan-Willem Frederiks, Doetinchem (NL)

(73) Assignee: NEDCON B.V., Doetinchem (NL)

( * ) Notice: Subject to any disclaimer, the term of this patent is extended or adjusted under 35 U.S.C. 154(b) by 319 days.

(21) Appl. No.: 18/554,523

(22) PCT Filed: Apr. 12, 2022

(86) PCT No.: PCT/EP2022/059784

§ 371 (c)(1),
(2) Date: Oct. 9, 2023

(87) PCT Pub. No.: WO2022/223375

PCT Pub. Date: Oct. 27, 2022

(65) Prior Publication Data

US 2024/0209620 A1 Jun. 27, 2024

(30) Foreign Application Priority Data

Apr. 20, 2021 (DE) ..... 10 2021 109 959.5

(51) Int. Cl.
*E04B 1/24* (2006.01)

(52) U.S. Cl.
CPC .... *E04B 1/2403* (2013.01); *E04B 2001/2415* (2013.01); *E04B 2001/2448* (2013.01);
(Continued)

(58) Field of Classification Search
CPC ..... E04B 1/2403; E04B 2001/2415; E04B 2001/2448; E04B 2001/2457; E04B 2001/2484; E04B 5/023; E04B 5/10
See application file for complete search history.

(56) References Cited

U.S. PATENT DOCUMENTS 3,604,167 A * 9/1971 Hays ..... E04B 1/944 52/327
4,186,535 A * 2/1980 Morton ..... E04B 1/98 52/250

(Continued)

FOREIGN PATENT DOCUMENTS

DE 3021090 A1 12/1981
DE 4123421 A1 1/1993

(Continued)

OTHER PUBLICATIONS

English translation of the Search Report and Written Opinion for PCT/EP2022/059784 (7 pages). (Year: 2023).*

*Primary Examiner* — Rodney Mintz
(74) *Attorney, Agent, or Firm* — Smartpat PLC

(57) ABSTRACT

A horizontal floor consists of a load-bearing structure and panels, which are laid thereon and together form a floor surface. The load-bearing structure is made up of at least one main profile, which is fastened on vertical supports, and secondary profiles, which are arranged transversely in relation to the main profile, are connected at their end to the main profile and on which the panels rest by way of their underside. Forces acting horizontally on the floor are absorbed by the load-bearing structure. For this purpose, a single piece connecting element is provided. The connecting element has a first fastening edge, a parallel second fastening edge, and a central portion between the two fastening edges. The first fastening edge is supported on the main profile and connected to it. The second fastening edge is supported on the underside of one of the panels and connected to this panel.

12 Claims, 2 Drawing Sheets

(52) U.S. Cl.
CPC ..... *E04B 2001/2457* (2013.01); *E04B 2001/2484* (2013.01)

(56) References Cited

U.S. PATENT DOCUMENTS

| | | | | |
|---|---|---|---|---|
| 5,927,036 | A * | 7/1999 | Matthews | E04C 3/086 52/696 |
| 6,256,958 | B1 | 7/2001 | Matthews | |
| 10,597,865 | B2 * | 3/2020 | Erlebach | E04B 1/388 |
| 10,633,853 | B2 * | 4/2020 | Erlebach | A47K 3/405 |
| 2002/0005022 | A1 * | 1/2002 | Matthews | E04B 5/10 52/696 |
| 2010/0024331 | A1 * | 2/2010 | Stiffler | E04B 5/40 52/236.8 |
| 2019/0323224 | A1 * | 10/2019 | Erlebach | E04B 1/388 |
| 2019/0323225 | A1 * | 10/2019 | Erlebach | A47K 3/405 |
| 2024/0295123 | A1 * | 9/2024 | Stafford | E04C 3/07 |

FOREIGN PATENT DOCUMENTS

| | | | |
|---|---|---|---|
| DE | 202016104526 | U1 | 9/2016 |
| EP | 0699840 | A1 | 3/1996 |
| EP | 1031669 | A1 | 8/2000 |

* cited by examiner

HORIZONTAL FLOOR MADE UP OF A LOAD-BEARING STRUCTURE AND FLOOR PANELS LAID THEREON

CROSS-REFERENCE TO RELATED APPLICATION

This application is a national stage application, filed under 35 U.S.C. § 371, of International Patent Application PCT/EP2022/059784, filed on Apr. 12, 2022, which claims the benefit of German Patent Application DE 10 2021 109 959.5, filed on Apr. 20, 2021.

BACKGROUND

In the course of the strong growth of the logistics sector, there is a need for intermediate stores having load-bearing structures in the form of racks for European pallets, for example, which are larger and larger and optimized in terms of the space they offer. The objective in the design of such stores is to create as much storage capacity as possible with the lowest possible requirement for space. In order to keep the costs low, the load-bearing structures often consist of profiles and cold-formed metal panels, which are mounted on the load-bearing structure in the manner of a construction kit. In addition, it is attempted to reduce the number of vertical supports that reduce the actually usable storage area. In order nevertheless to ensure the structural integrity of the load-bearing structure, it is in turn necessary to reinforce the horizontal load-bearing profiles. The cold-formed load-bearing profiles often used do not, however, exhibit high strength in all loading directions, which from time to time makes it necessary to fall back on massive double-T supports, which have been produced in a hot-forming process, in the main supports. Secondary profiles are fastened to these massively configured main profiles, arranged transversely with respect to the latter. The secondary profiles are produced from inexpensive cold-formed panels, often have an open, i.e. not closed, profile cross section and on their upper side have a sufficiently large supporting area on which the floor panels of the load-bearing structure are supported, wherein the floor panels are connected to the secondary profile by means of vertical screw fixings or alternatively riveted thereto.

However, the secondary profiles, which are only cold-rolled and often have an open profile cross section, are not suitable to absorb all the loads acting on the secondary profiles in the horizontal direction equally well. Primarily disadvantageous are high shear loadings, namely horizontal forces acting transversely in relation to the longitudinal extent of the secondary profiles. Their influence is disadvantageous above all in the area of fixing the secondary profile to the main profile. Here, disadvantageous shear loadings can occur, for example, when heavy goods are shifted horizontally on the panels screwed to the secondary profiles.

SUMMARY

The disclosure relates to a horizontal floor consisting of a load-bearing structure and panels which are laid thereon and together form a floor surface, wherein the load-bearing structure is made up of at least one main profile fastened to vertical supports and secondary profiles arranged transversely in relation to the main profile, which are connected to the main profile at their end and on which the panels rest by way of their underside.

An object of the present disclosure consists in developing the load-bearing structure of a horizontal floor further by means of design measures such that all the horizontal forces acting on the floor are absorbed optimally by the load-bearing structure.

To achieve the object, a horizontal floor having the features as claimed is proposed.

Accordingly, the disclosure proposes in particular a connecting element which is made up in one piece of a first fastening edge, a second fastening edge parallel to the first fastening edge and a central section between the two fastening edges. The first fastening edge is at least indirectly supported on the main profile and connected to the latter. The second fastening edge is supported on the underside of one of the panels and connected to this panel.

With the horizontal floor, a load-bearing structure for a horizontal floor is created which is distinguished by a high resistance with respect to horizontal loadings in a plurality of horizontal directions.

As a result of the additional connecting elements, an additional connecting structure is created between the panels and the load-bearing structure, which improves the load-bearing ability and resistance of the horizontal floor as compared with the horizontal floors and load-bearing structures known from the prior art.

The panels lie on the secondary profiles and are connected to the latter, preferably by means of vertical screw fixings.

It may be advantageous if the connecting elements, although they are connected to the main profile and the panel and in particular screwed, are not likewise connected to the secondary profile. This is because in order to counteract horizontal shear forces, it is sufficient if the connecting elements are supported by their first fastening edge on the main profile and by their second fastening edge on the underside of the panel and are connected to the latter. This leads to a type of indirect anchoring of the panels to the main profile in one of the total of two horizontal directions.

When use is made of the main profiles, which are often produced roughly by hot rolling, there may be a vertical clearance between the main profile and the underside of the panel respectively arranged above the main profile. If the main profiles are connected to the panels via the connecting elements, it is not necessary to machine the main profiles such that flat support of the panels on the main profiles would be possible. Instead, the connecting elements and the secondary profiles permit the maintenance of a vertical clearance above the main profile, which means that a flat upper side of the main profile can be dispensed with.

Preferably, the first fastening edge is configured in the form of a strip and is supported on and fastened to a vertical profile section of the main profile. This measure permits simple mounting of the connecting element on the main profile, since lateral accessibility is also possible. In addition, as a result of the lateral attachment of the connecting element to the main profile, straightening of the main profile can be dispensed with. Furthermore, the overall space needed for the connection is kept small as a result of the lateral attachment of the connecting element.

The ends of the secondary profiles are preferably connected to the main profile via a respective connection element, wherein the connection element is fastened to the secondary profile by a connecting region and to the main profile by a connection flange at right angles to the connecting region. In other words, the connection element represents the connecting link between the profile end of the secondary profile and the main profile.

In order that the outlay for assembly is not substantially increased by the connecting element as an additional component, the first fastening edge can be supported on the main profile only indirectly, specifically with the interposition of the connection flange. Thus, the first fastening edge together with the connection flange of the connection element can be fixed by the same fastening means, preferably a screw fixing or riveting. Furthermore, it is conceivable that a bolt is welded to the vertical section of the main profile, the connection flange and the first fastening edge being screwed to this bolt.

The connection between the first fastening edge and the main profile is preferably composed of at least two screw fixings spaced apart from each other in the longitudinal direction of the fastening edge, the spacing of which is at least 50% and preferably at least 75% of the length of the first fastening edge. The screw fixings are therefore arranged more in the end regions of the strip, so that the connecting element is in each case fixed to the main profile or to the main flange via its end regions. In order to maximize the moment of resistance with respect to shear forces that is increased by the connecting element, it is necessary to design the attachment regions of the first fastening region to be as long as possible in relation to the total length of the connecting element and to the length of the second fastening region.

The second fastening edge is also configured in the shape of a strip. It is supported on the underside of the panel forming the floor surface and connected to the latter. It can be supported with a further part of its length on the underside of another panel and thus also connected to this other panel.

The two fastening edges of the connecting element are configured as flat strips with a main extent parallel to the main profile and transverse in relation to the secondary profiles.

The central section of the connecting element is preferably assembled from two portions connected at a bending line, wherein the bending line extends parallel to the two fastening edges and therefore also parallel to the main profile.

The at least one main profile is, for example, a double-T support made of hot-rolled steel, since the latter is particularly suitable to absorb not only vertical but also horizontal forces and loads and dissipate them to the vertical supports of the load-bearing structure.

The main profiles are therefore preferably steel supports produced in a hot-rolling process. These have horizontal profile legs at the upper and lower end of their vertical profile section. In order to fasten the first fastening edge of the connecting element to the vertical profile section of the steel support and the second fastening section to the panels, it is necessary to connect the two fastening edges via a portion which runs underneath the upper horizontal profile leg of the support.

The aforementioned portions are a horizontal and a vertical portion, the portions preferably extending at right angles to each other at the bending line and each portion respectively being connected to the respective fastening edge via a further bending line. In particular, the fastening edges are arranged at right angles to the portions. This likewise step-like configuration of the connecting element ensures stiffening of the connecting element itself and, following its mounting, good reinforcement with respect to horizontal shear loadings, specifically horizontal forces acting transversely relative to the longitudinal extent of the secondary profiles.

Preferably, the connecting element is a metal plate shaped by bending processes, wherein the initial plate is rectangular or trapezoidal. The production of the connecting element in such a process is economical.

Further measures will be explained in more detail below together with the description of a preferred exemplary embodiment and with reference to the figures.

DETAILED DESCRIPTION

Figure 1:
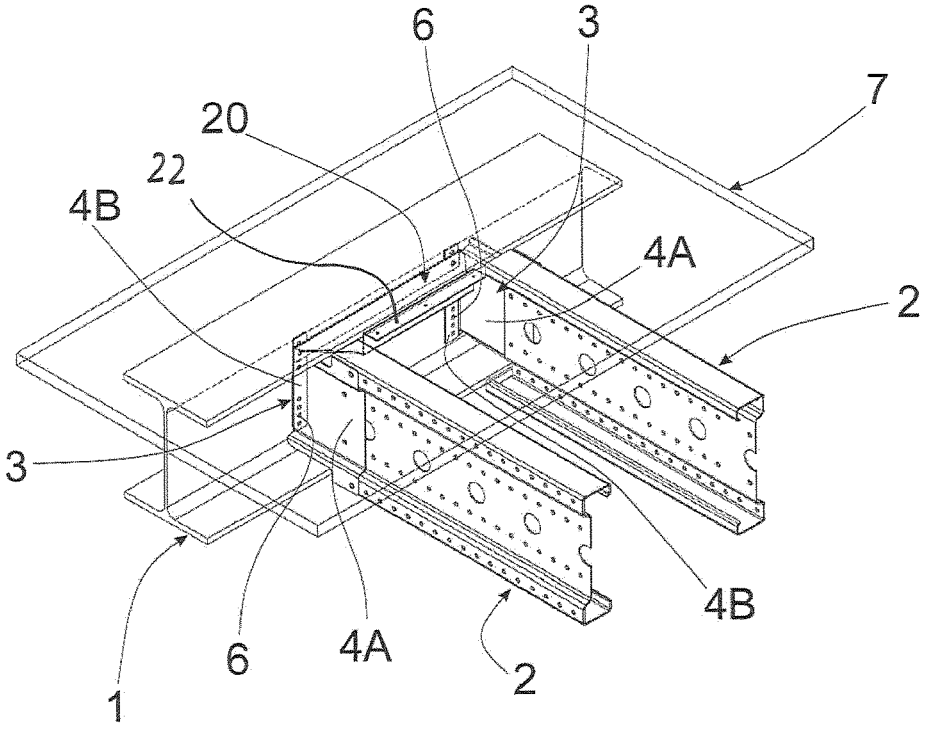
FIG. 1 shows a perspective view of a portion of a load-bearing structure made of main and secondary profiles and the panels installed thereon via connecting elements.

FIG. 1 shows a perspective view of a portion of a horizontal floor used in the storage and logistics area, consisting of a load-bearing structure and panels 7 laid thereon and together forming a flat floor surface.

The load-bearing structure is made up of the vertical supports, not illustrated, main profiles 1 fastened thereto and secondary profiles 2 arranged transversely in relation to the main profiles 1 and fastened laterally to the main profiles. All the main profiles 1 and secondary profiles 2 extend horizontally.

In the interspace between each two secondary profiles 2, a connecting element 20 is additionally fastened to the main profile 1. The secondary profiles 2 and the connecting element 20 each form with their upper sides a support for the underside 7A of the panel 7 or the panels 7.

The ends of the secondary profiles 2 are not connected to the main profile 1 directly but via a respective connection element 3. For this purpose, the connection element 3 is fastened to the secondary profile 2 by a connecting region 4A and to the main profile 2 by a connection flange 4B at right angles to the connection region 4A. To attach the secondary profile 2 to the connecting region 4A of the connection element 3, it is also conceivable for both components to have a complementary contour in order to produce a form-fitting and force-fitting connection when plugged into each other. In principle, a screw connection or riveting or a combination of screw connection and riveting and a form fit between connection element 3 and secondary profile 2 is also possible.

The connecting element 20 is advantageous with regard to the transmission of shear loadings, namely horizontal forces acting transversely in relation to the longitudinal extent of the secondary profiles 2, to the load-bearing structure. Their influence is primarily disadvantageous in the region of the connection of the secondary profiles 2 to the main profile 1, here therefore in practical terms in the region of the connection elements 3. Disadvantageous loading states can occur in particular when heavy goods are pushed onto the panels 7 screwed to the secondary profiles 2. This is because the secondary profiles 2 are better able to accommodate horizontal forces in the direction of their own longitudinal extent than horizontal forces transverse to their own longitudinal extent.

The individual connecting element 20 is made up of a first fastening edge 21, a second fastening edge 22 parallel to the first fastening edge 21 and a central section 25 between the two fastening edges 21, 22. The first fastening edge 21 is at least indirectly supported on the vertical profile section of the main profile 1 and screw-connected to the latter, here with the interposition of the connection flange 4B. The first fastening edge 21, the connection flange 4B and the main profile 1 thus form a common connection region.

Although the connecting element 20 is connected to the main profile 1 and to at least one panel 7, it is not connected to the secondary profile 2. Consequently, a force acting on the panel 7 transversely relative to the longitudinal extent of the secondary profile 2 is transmitted via the connecting element 20 to the massively and stably configured main profile 1 and not primarily to the secondary profiles 2. This leads to the load on the secondary profiles 2 being relieved, above all in the region of the connection elements 3.

The fastening edge 22 of the connecting element 20 and the secondary profiles 2 reach higher than the upper side of the main profile, with the consequence of a vertical clearance 16 between the main profile 1 and the underside 7A of the panel 7 arranged above the main profile 1.

In order to be able to change the vertical clearance 16, the connection element 3 can be formed with a plurality of holes 6 arranged vertically one above another on the connection flange 4B. As a result of the many holes 6, the connection element 3 can be fastened to the vertical profile section of the main profile 1 in various vertical positions.

The connection between the first fastening edge 21 and the main profile 1 is preferably made by means of two screws 17 which are spaced apart considerably relative to each other in the longitudinal direction of the fastening edge 21, which engage in holes in the vertical profile section of the main profile 1 and the spacing of which is at least 50% and preferably at least 75% of the total length of the first fastening edge 21. It is conceivable that more than two screws 17 and associated holes are also arranged along the first fastening edge 21 and the main profile 1, and connect these to each other.

Figure 2:
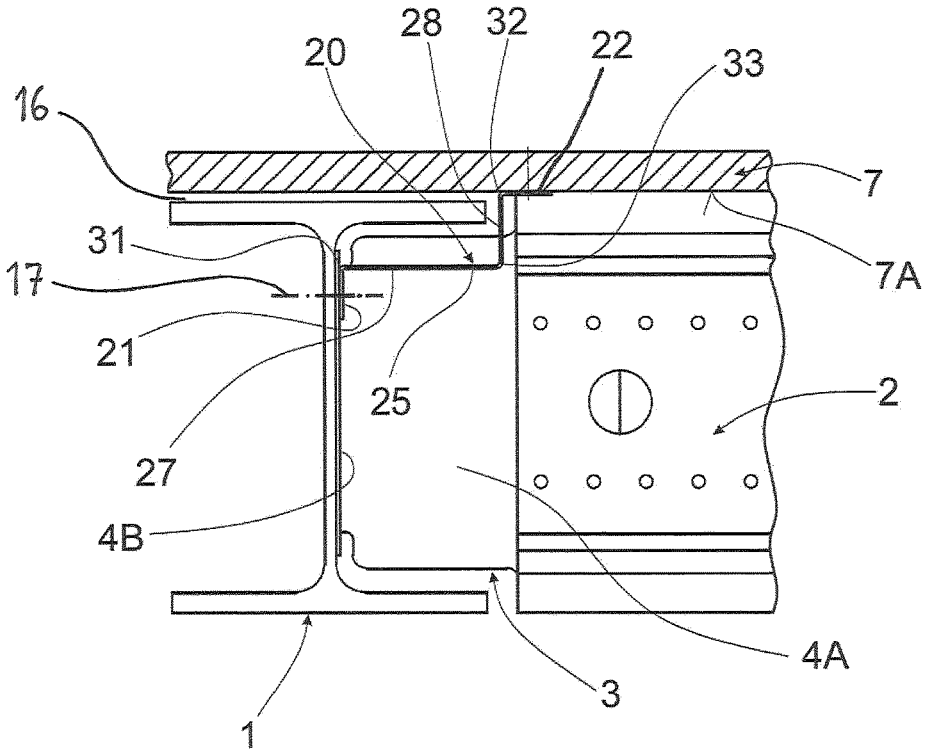
FIG. 2 shows a sectional view, running transversely relative to the main profile of the load-bearing structure.
Figure 3:
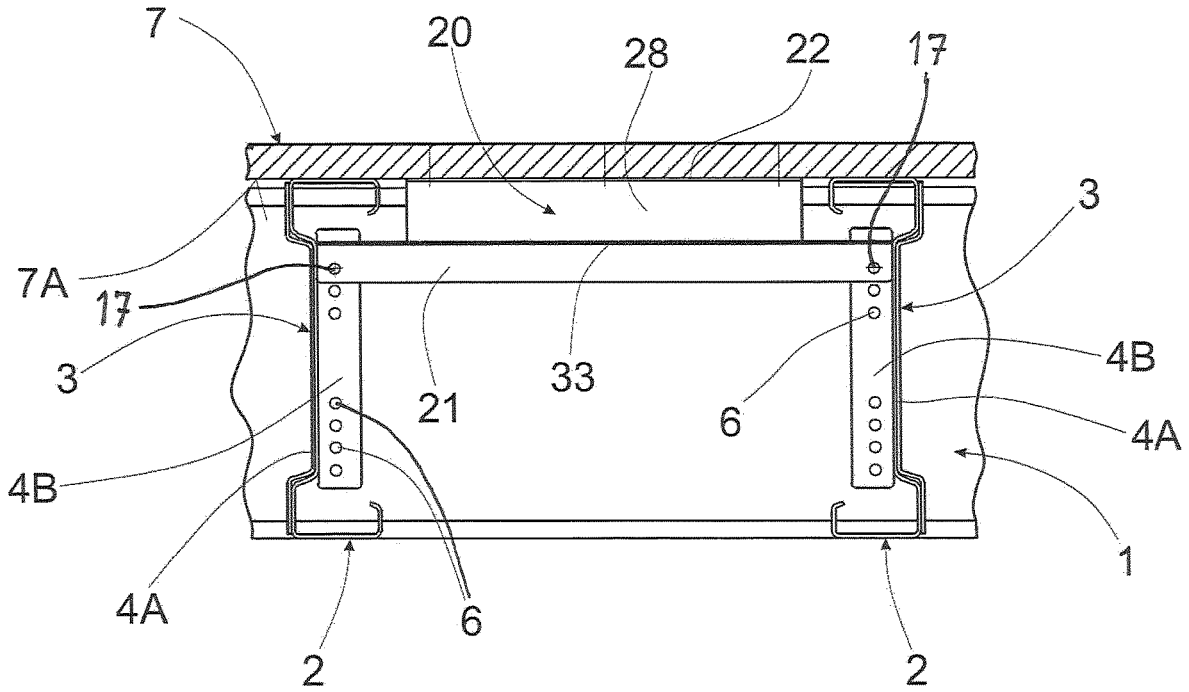
FIG. 3 shows a sectional view, running transversely relative to the secondary profiles.

Of course, further secondary profiles 2 and connecting elements 20 can also be placed on the main profile 1 from the other side, that is to say from the left in FIG. 2, wherein the fastenings can be made on both sides via common screw fixings.

The second fastening edge 22 of the connecting element 20 is supported on the underside 7A of the panel 7 and connected to the panel 7 via rivets or screws 18. The panel 7 lies on the secondary profiles 2 and is fastened thereto by means of the screws 18 or rivets. In order to make it easier, for example, for a load to slide on the floor panels, recesses are provided on the upper side of the panels 7, into which the screws or rivet heads are completely countersunk.

The main profile 1 is, for example, a steel support produced in a hot-rolling process, more precisely a double-T support with two horizontal legs running one above another and parallel to one another, and a vertical profile section connecting these. To fasten the first fastening edge 21 to the vertical profile section, the central section 25 of the connecting element 20 is made up of two portions 27, 28 connected at a bending line 33 extending parallel to the two fastening edges 21, 22 (FIG. 2). These portions are a horizontal 27 and a vertical portion 28, wherein the portions 27, 28 preferably extend at right angles to each other at the bending line 33, and wherein each portion 27, 28 is preferably connected to the fastening edge 21, 22 at a respective further bending line 31, 32.

In particular, the fastening edges 21, 22 are arranged at right angles to the portions 27, 28 arranged adjacent thereto. This likewise step-like configuration of the connecting element 20 ensures good stiffening of the load-bearing structure. However, a non-right-angled configuration is also possible, or another number of steps.

LIST OF DESIGNATIONS

1 Main profile
2 Secondary profile
3 Connection element
4A Connecting region
4B Connection flange
6 Hole
7 Panel
7A Underside of the panel
8 Panel underside
16 Clearance
17 Screw
18 Screw or rivet
20 Connecting element
21 First fastening edge
22 Second fastening edge
25 Central section
27 Horizontal portion
28 Vertical portion
31 Bending line
32 Bending line
33 Bending line

The invention claimed is:

1. A horizontal floor, comprising:
a load-bearing structure; and
panels (7) that are positioned on the load-bearing structure and together define a floor surface,
wherein the load-bearing structure comprises
a main profile (1) fastened to vertical supports,
secondary profiles (2) arranged transversely in relation to the main profile (1), the secondary profiles (2) being connected to the main profile (1) at respective ends thereof and supporting the panels (7) by way of an underside (7A) thereof, and
a unitary connecting element (20) made up in one piece of
a first fastening edge (21),
a second fastening edge (22) extending parallel to the first fastening edge, and
a central section (25) between the first fastening edge (21) and the second fastening edge (22),
wherein the first fastening edge (21) is at least indirectly supported on and connected to the main profile (1), and
wherein the first fastening edge (21) is connected to a vertical profile section of the main profile (1), and
wherein the second fastening edge (22) is supported on the underside (7A) of one of the panels (7) and is connected to the one of the panels (7).

2. The horizontal floor as claimed in claim 1,
wherein the panels (7) rest on the secondary profiles (2) and are screwed to the secondary profiles (2).

3. The horizontal floor as claimed in claim 1,
wherein the connecting element (20) is connected to the main profile (1) and to the one of the panels (7), but not to the secondary profiles (2).

4. The horizontal floor as claimed in claim 1,
further comprising a vertical clearance (16) between the main profile (1) and the underside (7A) of the one of the panels (7) respectively arranged above the main profile (1).

5. The horizontal floor as claimed in claim 1, wherein the connection between the first fastening edge (21) and the main profile (1) includes at least two screw fixings (17)

which are spaced apart from one another in a longitudinal direction of the first fastening edge (21) and a spacing of which is about 50% to about 75% of a length of the first fastening edge (21).

6. The horizontal floor as claimed in claim 1, wherein the connecting element (20) is a metal plate shaped by bending processes.

7. The horizontal floor as claimed in claim 1, wherein the main profile (1) is a steel support produced in a hot-rolling process.

8. The horizontal floor as claimed in claim 1, wherein the ends of the secondary profiles (2) are connected to the main profile (1) via a respective connection element (3), wherein the connection element (3) is fastened to the secondary profiles (2) by a connecting region (4A) and to the main profile (1) by a connection flange (4B) at right angles to the connecting region (4A).

9. The horizontal floor as claimed in claim 8, wherein the first fastening edge (21) is supported on the main profile (1) with interposition of the connection flange (4B).

10. The horizontal floor as claimed in claim 1, wherein the central section (25) of the connecting element (20) is made up of two portions (27, 28) connected along a bending line (33), wherein the bending line (33) extends parallel to the first fastening edge (21) and the second fastening edge (22).

11. The horizontal floor as claimed in claim 10, wherein the two portions (27, 28) extend at right angles to each other at the bending line (33).

12. The horizontal floor as claimed in claim 10, wherein each of the two portions (27, 28) is respectively connected to a respective said fastening edge (21, 22) at a further bending line (31, 32).

* * * * *